US009267302B2

(12) United States Patent
Steimle et al.

(10) Patent No.: US 9,267,302 B2
(45) Date of Patent: Feb. 23, 2016

(54) COMBINABLE AND INTERCHANGEABLE WATER FEATURES

(75) Inventors: Vanz Mark Steimle, Huntington Beach, CA (US); Martyn Keats, Moorpark, CA (US)

(73) Assignee: GSG HOLDINGS, INC., Chandler, AZ (US)

( * ) Notice: Subject to any disclaimer, the term of this patent is extended or adjusted under 35 U.S.C. 154(b) by 390 days.

(21) Appl. No.: 13/306,963

(22) Filed: Nov. 29, 2011

(65) Prior Publication Data

US 2012/0131741 A1 May 31, 2012

Related U.S. Application Data

(60) Provisional application No. 61/417,868, filed on Nov. 29, 2010, provisional application No. 61/466,539, filed on Mar. 23, 2011, provisional application No. 61/553,187, filed on Oct. 29, 2011.

(51) Int. Cl.
*E04H 4/14* (2006.01)
*E04H 4/16* (2006.01)

(52) U.S. Cl.
CPC ..... *E04H 4/169* (2013.01); *E04H 4/14* (2013.01); *E04H 4/148* (2013.01); *Y10T 29/49826* (2015.01)

(58) Field of Classification Search
CPC ..... A61H 33/6063; A61H 33/6021; A61H 33/0087; A61H 33/60; E04H 4/167; B05B 3/0463
USPC ..... 4/492, 541.1; 239/214, 214.15, 214.21, 239/237, 225.1, 263, 222, 222.11, 222.13
See application file for complete search history.

(56) References Cited

U.S. PATENT DOCUMENTS

| | | | | |
|---|---|---|---|---|
| 3,890,655 | A * | 6/1975 | Mathis | 4/541.6 |
| 5,014,372 | A * | 5/1991 | Thrasher et al. | 4/541.6 |
| 5,291,621 | A * | 3/1994 | Mathis | 4/541.4 |
| 5,920,925 | A * | 7/1999 | Dongo | 4/541.6 |
| 6,470,509 | B1 * | 10/2002 | Ayeni | 4/541.6 |
| 6,860,437 | B1 * | 3/2005 | Amendt et al. | 239/383 |
| 8,689,370 | B2 * | 4/2014 | Fleischer | 4/541.6 |
| 2006/0230518 | A1 * | 10/2006 | Holtsnider et al. | 4/541.6 |
| 2007/0033725 | A1 * | 2/2007 | Holtsnider | 4/541.6 |
| 2009/0126099 | A1 * | 5/2009 | Holtsnider | 4/541.6 |
| 2009/0133188 | A1 * | 5/2009 | Peng et al. | 4/541.6 |

OTHER PUBLICATIONS

Schechner, Dan, article entitled: Balboa Acquires Parts Supplier; downloaded from http//www.poolspanews.com (posted Jan. 1, 2009; printed on Feb. 28, 2014).

(Continued)

*Primary Examiner* — Lauren Crane
*Assistant Examiner* — Erin Deery
(74) *Attorney, Agent, or Firm* — Booth Udall Fuller, PLC

(57) ABSTRACT

Combinable and interchangeable water features used on a standard universal mounting system to create the desired color, style, jet, directional flow, filter, light, return fittings, or other water feature for a pool or spa. Some water features include removably attached and rotatable male receptor and female receiver connections to create a variety of water effects.

12 Claims, 14 Drawing Sheets

(56) References Cited

OTHER PUBLICATIONS

Internet Archive Wayback Machine; Hydro Air Gunite Micro' ssageTM Jet Assemblies, downloaded from http//web.archive.org/web/2008200862848/http:www.hydroairusa.com/products/poolspa_oem_p;roducts/gunite_jets_products/gunite_asse . . . (archived Aug. 20, 2008-Sep. 8, 2009; printed on Feb. 28, 2014).

Screenshot of HydroAir Gunite Jets website; ITT Industries (on information and belief, available before Mar. 2009).

Internet Archive Wayback Machine; Balboa Direct Thera'ssage spa jet (archived Feb. 19, 2011-Aug. 23, 2012).

Letter of Jan. 18, 2013, from Gary S. Minor regarding correction of inventorship, in which Mr. Minor disputes being removed as an inventor, but did not then and has not since provided any documents to corroborate his positions. The subject matter attributable to Mr. Minor was originally claimed in original Claim 12, which was cancelled by Applicant and will not be claimed in the future. Based on documents in Applicant's possession, and upon review by the undersigned, the inventorship in the instant application is now correct.

* cited by examiner

COMBINABLE AND INTERCHANGEABLE WATER FEATURES

CROSS-REFERENCE TO RELATED APPLICATIONS

This application claims priority under 35 U.S.C. §119 to the following U.S. Provisional Patent Applications, which are hereby incorporated by reference in their entirety: U.S. Ser. No. 61/417,868 filed Nov. 29, 2010, titled, "System and Method for Interchangeable Water Features;" U.S. Ser. No. 61/466,539 filed Mar. 23, 2011, titled, "Rotating Therapeutic Spa Jet;" and U.S. Ser. No. 61/553,187 filed Oct. 29, 2011, titled, "System and Method for Removable Directional Water Flow Features."

COPYRIGHT STATEMENT

A portion of the disclosure of this patent application document contains material that is subject to copyright protection including the drawings. The copyright owner has no objection to the facsimile reproduction of the patent document or the patent disclosure as it appears in the Patent and Trademark Office file or records, but otherwise reserves all copyright rights whatsoever.

BACKGROUND OF THE INVENTION

1. Field of the Invention

The present application relates to interchangeable water features used in spas and pools.

2. Description of the Prior Art

In the spa and pool building industry a variety of jets, drains, and other water features are used to filter, clean, and enhance the functionality and aesthetics of a particular spa or pool. Often many of these water features are desired as afterthoughts and may be costly to add as a result. One reason for the expense is once the initial ground spa or pool is formed from concrete, gunite, or other setting materials it becomes difficult to add additional holes in the structure without compromising the integrity of the structure. Other reasons include the complexity of the individual parts that are often comprised of multiple components and water features built on a non-uniform platform or design that lack interchangeability.

Styles, colors and new or different water features may be sought for after the completion of a pool or spa, so what is desired is a system that can anticipate and adapt to newly invented water features, color changes, and styles as the pool or spa owner desires without high costs and complex solutions. A system where the interchangeability of features is made with relative ease and at low costs. Additionally, a system that can be formed into the original formation of a pool or spa without further need to modify the shell or lining is what this application seeks to address.

SUMMARY OF THE INVENTION

A water spindle comprised of a body having an annular opening, wherein a main fluid channel extends into the body from the annular opening; an egress plane formed on one end of the body, wherein the egress plane contains at least one egress extending from the main fluid channel or where the main channel branches into multiple sub-channels an egress from each sub-channel. A male receptor extends from the egress plane, where it is configured to rotatably connect with a female receiver of a water feature cover or faceplate. This male receptor is positioned substantially concentric with the annular opening on the opposite end of the body of the spindle. An axis is formed about this concentric alignment about which the spindle rotates when connected with a water feature cover.

A water feature cover comprising a hollow annular-shaped body having an annular shaped opening defining a proximal end of the body and a cover containing at least one fluid aperture defining the distal end of the body. A cavity is formed between the proximal and distal ends and at least one external locking tab extends into the cavity from the body, which is used to lock or engage with a universal mount by inserting the water feature cover into the universal mount and rotating it until the respective locking tabs of each component engage. This fixes the water feature cover to the universal mount. The water feature cover also has a female receiver formed in the cover or face plate portion. The female receiver is substantially concentrically aligned with the annular opening at the proximal end. This female receiver is configured to rotatably and removably attach to the male receptor of the spindle. The spindle when attached to the water feature cover can now rotate about the axis formed along the connection. In some embodiments the male receptor merely pivots about the female receiver.

A universal mount comprising an annular opening formed on the proximal end of a mount body extends into a cavity formed inside the mount body. The cavity extends from the annular opening to an outlet on the distal end of the mount body where at least one internal locking tab extends into the cavity. As mentioned this locking tab is configured to rotatably lock or firmly fix into place with the external locking tab of the water feature cover. Also formed on the mount body are at least two flanges extending annularly along an outer wall of the mount body. These flanges help ensure proper water sealing when forming the universal mount into the concrete or gunite shell of a pool or spa.

Combining the spindle, water feature cover and universal mount forms a spa jet system to be used in conjunction with a venturi jet tee pipe, other pipe, or system that mixes air and water. In another embodiment, a second removable protrusion or locking device extends from the egress plane of the spindle. This second protrusion acts as a block or locking mechanism that works with a water feature cover, to prevent the spindle from rotating about an axis. As a result, a controllable directional flow water feature is formed.

DETAILED DESCRIPTION OF THE PREFERRED EMBODIMENT

Figure 1A:
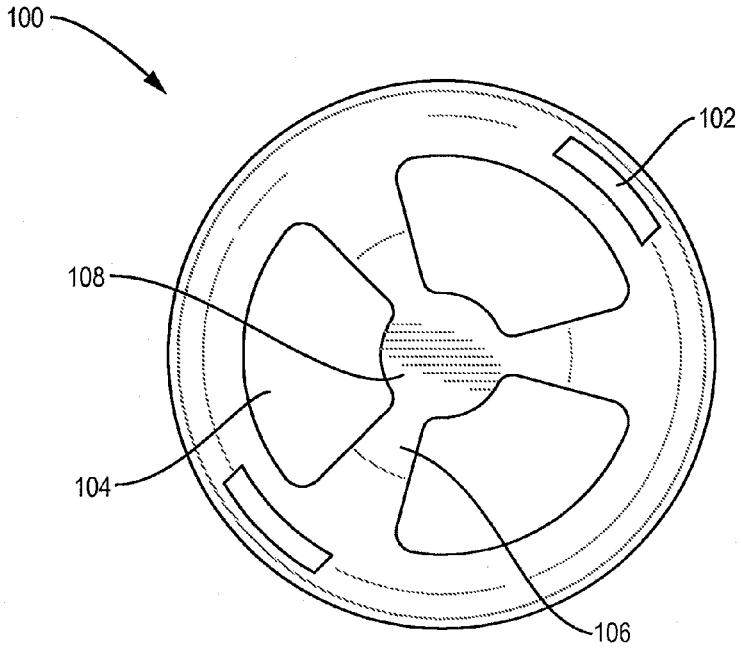
FIGS. 1-4D illustrate schematic drawings of various interchangeable water feature covers.
Figure 1B:
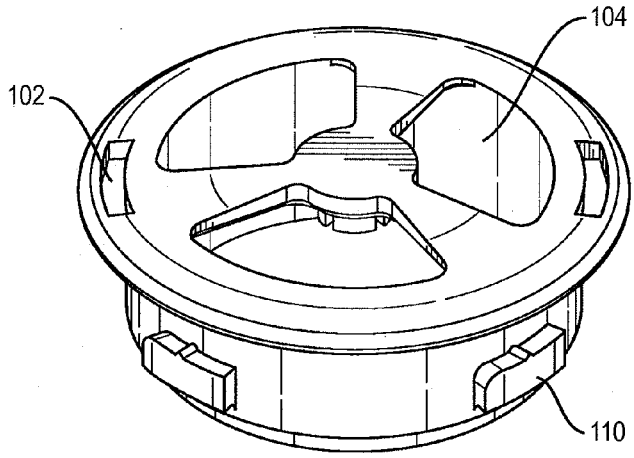
Figure 1C:
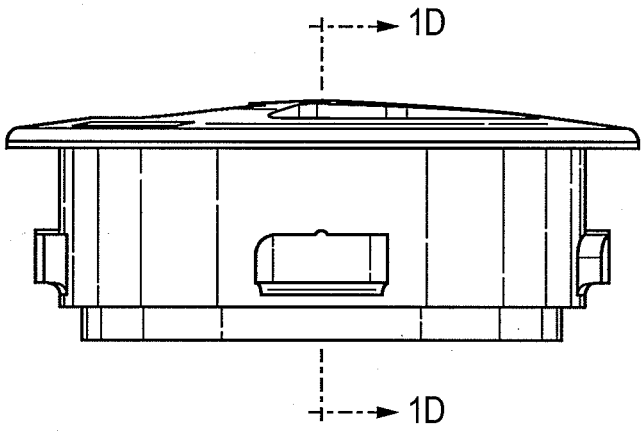

As mentioned, by reducing the number of components a particular water feature is made of helps reduce the overall manufacturing cost. By integrating these water features to be used in conjunction with a universal platform or mount adds flexibility to any pool or spa system.

For instance, FIGS. 1-4D illustrate a variety of water feature covers that may be implemented in such a flexible system. In FIGS. 1A-D, a water feature cover or face plate 100 is shown having three fluid apertures 104 on the top or cover portion 108 that allow for water to pass through. Face plate 100 also has two slots 102 configured for a tool to twist or rotate the faceplate 100 into a locking position. This particular faceplate 100 is configured with four locking tabs 110 that extend from the annular body portion of the faceplate. In this embodiment, locking tabs 110 are configured with a rounded corner and vertical protruding bump that allow them to be fixed into place with the corresponding internal locking tab 511 having complementary features as illustrated in FIGS. 5A-D. A vertical protruding bump is an optional feature of the locking tabs described herein and in some embodiments it may be removed. Similarly, the complementary divot or groove described below and associated with the vertical protruding bump may also be removed. The locking tabs apply opposite forces to each other as result of their respective components being in tension.

Figure 1D:
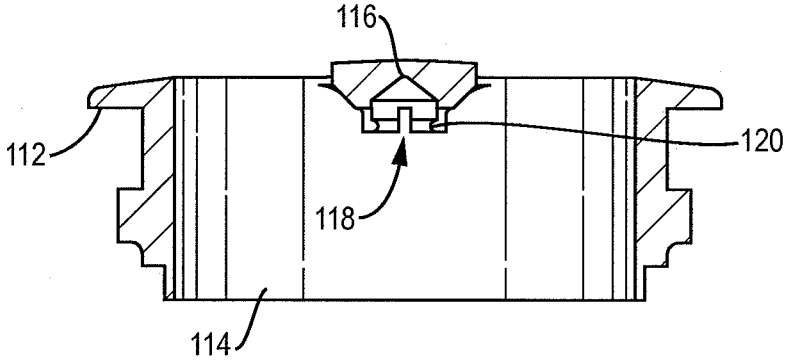
Figure 2A:
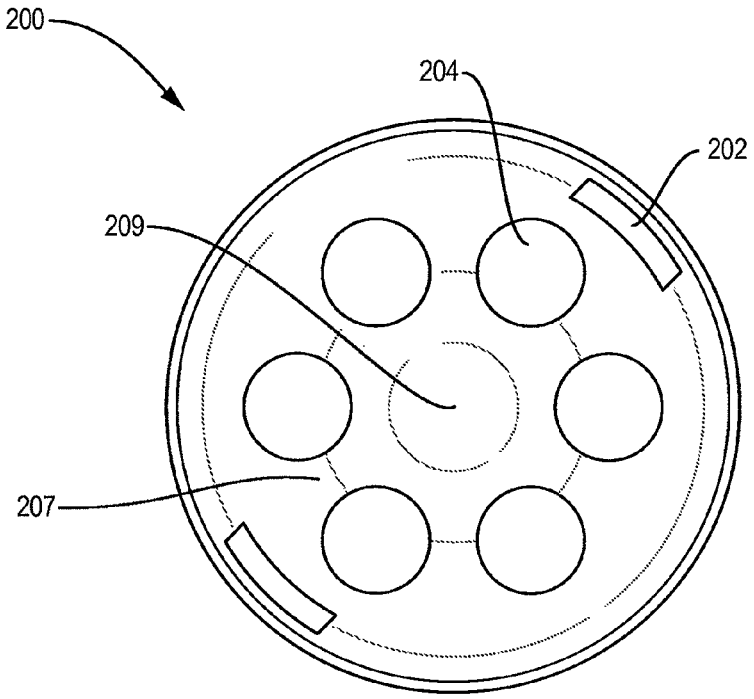
Figure 2B:
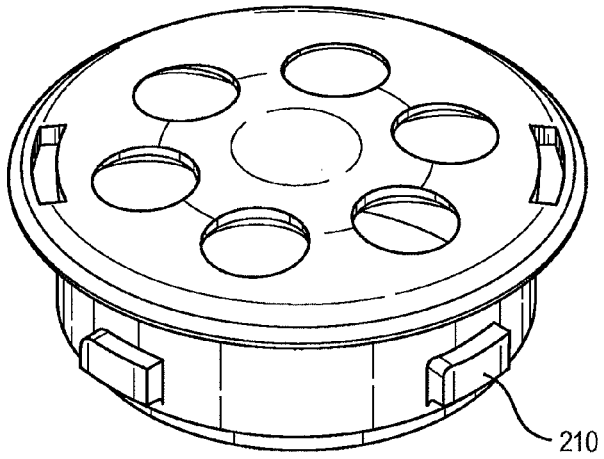
Figure 2C:
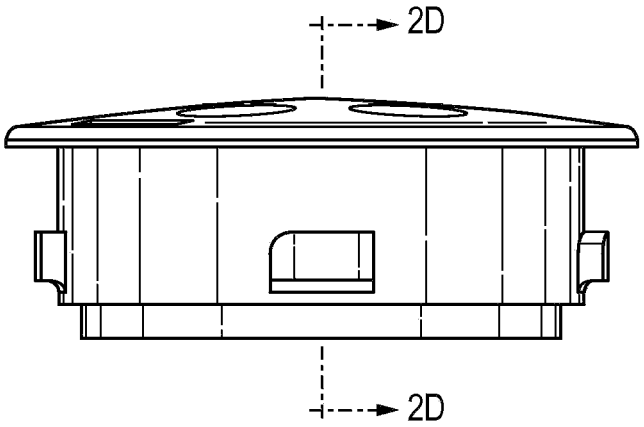
Figure 2D:
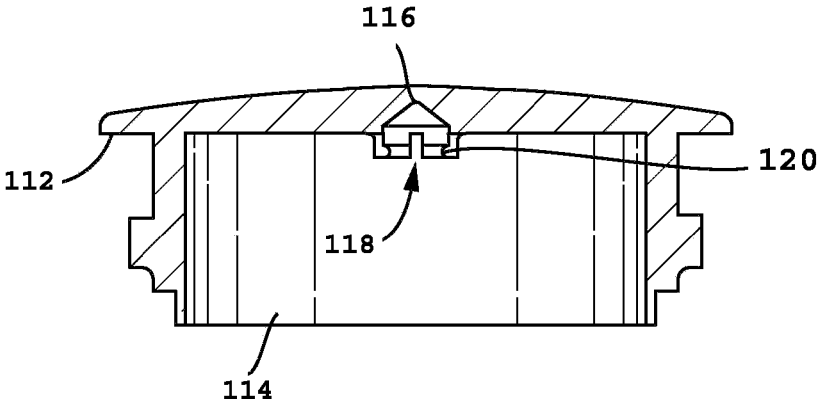
Figure 3A:
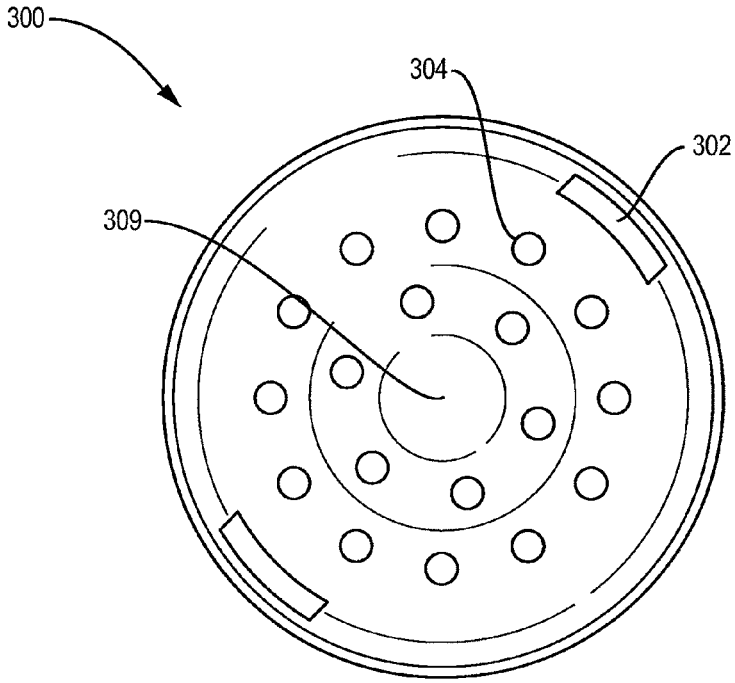
Figure 3B:
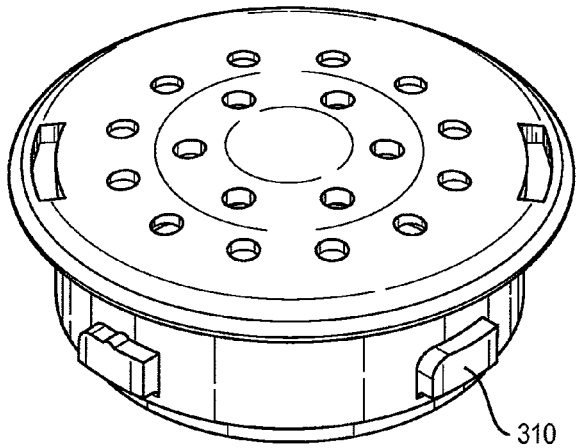
Figure 3C:
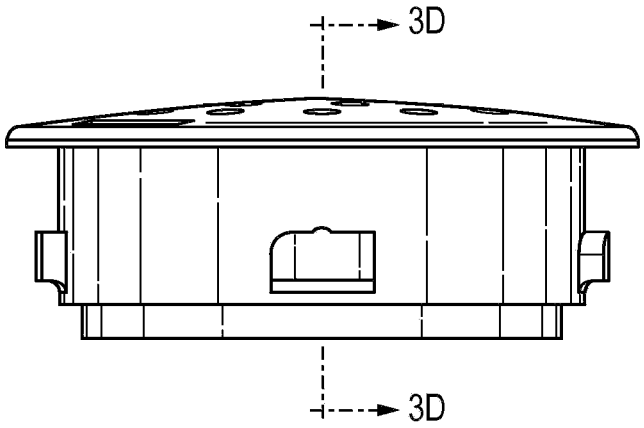
Figure 3D:
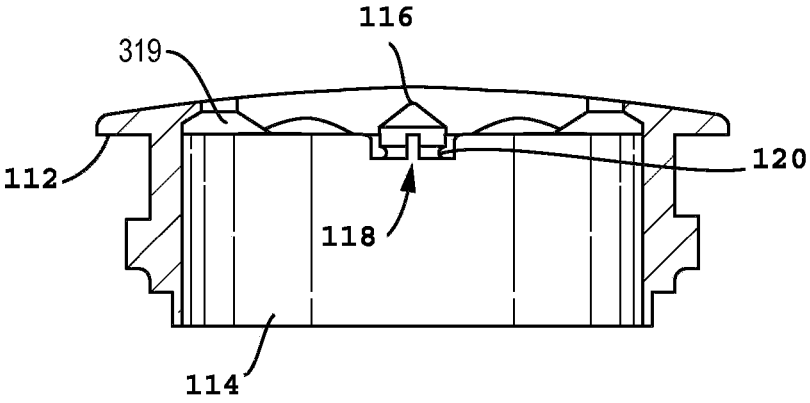
Figure 4A:
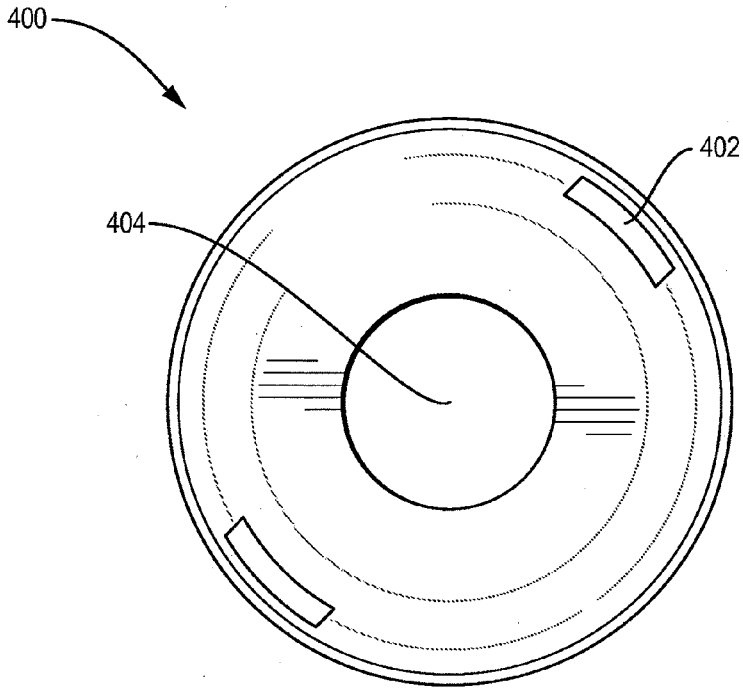
Figure 4B:
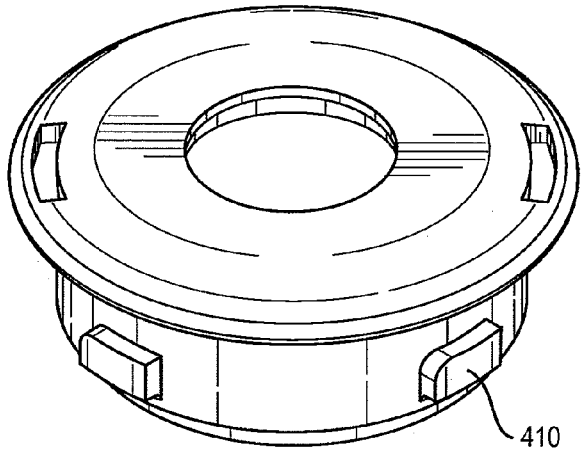
Figure 4C:
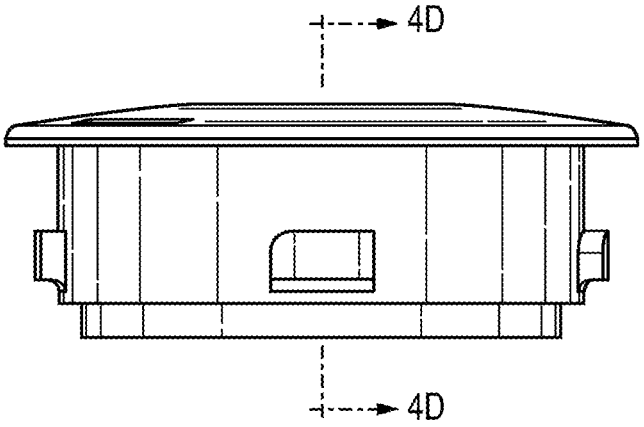
Figure 4D:
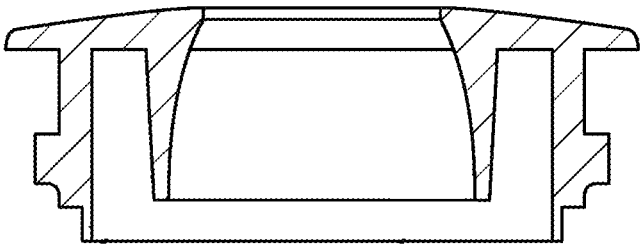

FIG. 1D, illustrates a cross-sectional view showing the internal features of faceplate 100. An annular cavity 114 is configured to accommodate the egress plane portion of a water spindle or water director discussed below. The annular cavity is formed by the annular walls (not labeled), the cover 108, and an annular opening 122 on the bottom of faceplate 100.

Also shown in FIG. 1D, is female receiver 118 formed partially in cover 108. Female receiver 118 is generally centered within the cover 108 to be concentric with the faceplate. Female receiver 118 has an inverted tip or apex 116 to accommodate a conical shaped or pointed male receptor. Securing tabs 120 are formed around the opening of female receiver 118. In this embodiment, slots or slits (not shown) are formed in the sidewalls (not labeled) of the female receiver 118 as illustrated. These slots allow for the sidewalls to expand easier when press fitting a male receptor into the female receiver 118. Securing tabs 120 then keep the attached male receptor in place as they form an edge for a complementary lip from the male receptor to rest on, thus preventing the male receptor from easily sliding out. However, it should be noted that with sufficient force a male receptor and the female receiver may be disengaged. This removably attachable feature of the female receivers used in a variety of faceplate designs disclosed herein allows for interchangeability to the user. For instance, a user may have one color faceplate installed, but then desire a different color be used. These faceplates provide a simple system to easily swap in and out water features according to their desired preference. In other embodiments not illustrate the female receiver merely acts as pivot point for the male receptor to rotate about and may not include securing tabs and sidewalls.

It should be noted that flanges 112 extend sufficiently from the top portion of the faceplate to cover the outlet portion of a universal mount. Thus, if a user has a universal mount that is green, but they would like all of their pool features to be red, red faceplate may be inserted insufficiently cover the green portion of the universal mount from showing. The flanges provide a stop so a user knows how far to insert the faceplate into a universal mount before twisting and locking it into place. In some embodiments, the flanges work in conjunction with the locking tabs to provide a bracing surface along with an edge of the external locking tabs, which places the faceplate in tension as these bracing surfaces are rotated and locked in tension with the mounting surface and internal locking tab of the universal mount described below. By placing both the universal mount and faceplate in tension with each other they become removably fixed to each other. This removable fixing may also be referred to as locking the components in place.

Other embodiments illustrated use locking tabs that do not require the tension of a substantial portion of the component, but rather focus on the locking tension of the tab itself. E.g. some interlocking tabs may use complementary male and female tabs to secure the faceplate and universal mount to one another and are within the scope of this application. It is contemplated to also use a thread and screw system; however, is often quicker to install and uninstall.

FIGS. 2A-D illustrate another embodiment of a water feature cover or faceplate 200. In this embodiment, six fluid apertures 204 are formed in cover 209. These fluid apertures are formed concentrically around the center of the cover and have equal spaced webbing 207 between them. Faceplate 200 also has two slots 202 configured for a tool to twist or rotate the faceplate 200 into a locking position.

FIGS. 3A-D illustrate another faceplate 300 having a plurality of smaller fluid apertures 304. In this particular embodiment, the fluid apertures 304 have a larger inlet then outlet. As drawn, in FIG. 3D a sloped interface 319 reduces the larger inlet to the smaller outlet. Faceplate 300 also has two slots 302 configured for a tool to twist or rotate the faceplate 300 into a locking position.

FIGS. 4A-D illustrate faceplate 400, which does not have a female receiver formed in the cover. Faceplate 400 also has two slots 402 configured for a tool to twist or rotate the faceplate 400 into a locking position. As drawn, a larger fluid aperture 404 appears in the center of the cover. Faceplate 400 may be used in conjunction with a variety of water features. Some of these include lights, tethering ropes or mounts, intakes, and so forth. E.g. Fluid aperture 404 may contain a window (transparent or colored) where an illuminating device may be placed behind within the universal mount. In all of these embodiments one, two, three, or more locking tabs may be used.

Again as encompassed in the scope of Fig. 4A-D, having a plurality of interchangeable face plates and other interchangeable features in conjunction with the universal mount add a lot of flexibility to a swimming pool or spa system. In turn, this alleviates the high cost of modifying a pool or spa.

Universal mount 500 is illustrated in Fig. 5A-D. As previously discussed, building water features on a common universal mounting system enables for ease and reduction of cost when modifying a pool or spa. As illustrated, universal mount 500 has four locking tads 511. Mentioned above, these locking tabs 511 work in conjunction with locking tabs of the faceplates. Locking tabs 511 have a similar rounded corner 531 and complementary vertical divot or groove 529 with the locking tab features of the faceplate locking tabs. Additionally , 511 has a s stopping arm 533 to prevent any additional turning when the locks are firmly in place. The locking tab features of the universal mount 500 and faceplates 100, 200, 300 and 400, may be swapped, meaning the faceplates have a locking tab design as shown on the universal mount and vice versa.

Mounting surface 503 is generally aligned to be flush or coplanar with the interior pool or spa surface. In some instances, it may be slightly regressed into the gunite or concrete shell of the pool or spa. However, most of the faceplates and other water features configured to mount with the universal mount are configured to cover the mounting surface with an extending annular flange, so that the color of the universal mount becomes less relevant as it will not be showing once capped or covered with a faceplate or other water feature. The mounting surface 503 also defines the outlet or opening on the distal end of universal mount 500.

Flanges 505 and 507 extend from the outer walls of the upper distal end of universal mount 500. These flanges serve several purposes. One purpose is to function as a securing mechanism when forming universal mount 500 into a concrete or Gunite shall. These flanges also function as sealing mechanisms or water barriers to prevent water from leaking around and through the Gunite shell portion where the universal mount has been formed therein. Often, a universal mount will be pre-connected to a corresponding water, air, and/or electrical conduit pipe, e.g. a venturi jet tee, before the shell of the pool is formed. By forming a plurality of these universal mounts into the shell of a swimming pool when it is being formed, allows for flexibility to change water features and colors later on. After the universal mounts have been properly formed into the shell of a pool or spa, they may be easily combined with other water features to create the desired pool or spa effects.

These universal mounts can be used for anchors, light mounts, spa jet systems, directional flow features, fountains and so forth.

Figure 5A:
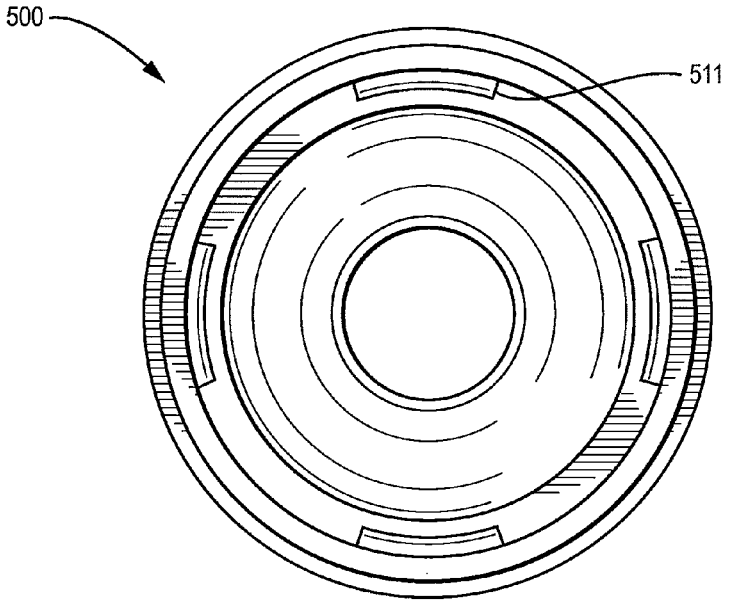
FIGS. 5A-D illustrate schematic drawings of a universal water feature mount.
Figure 5B:
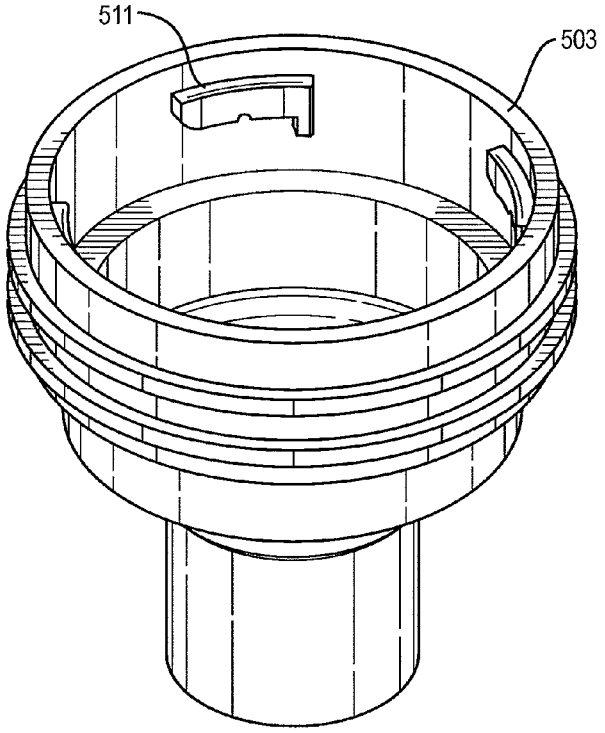
Figure 5D:
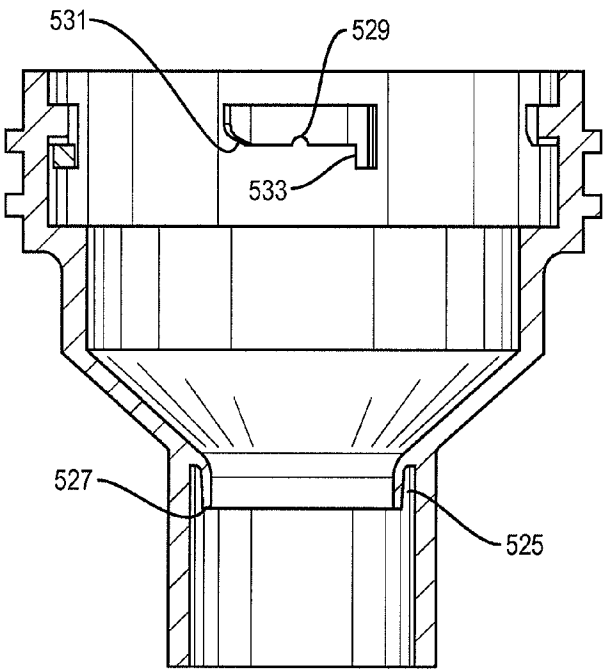
Figure 5C:
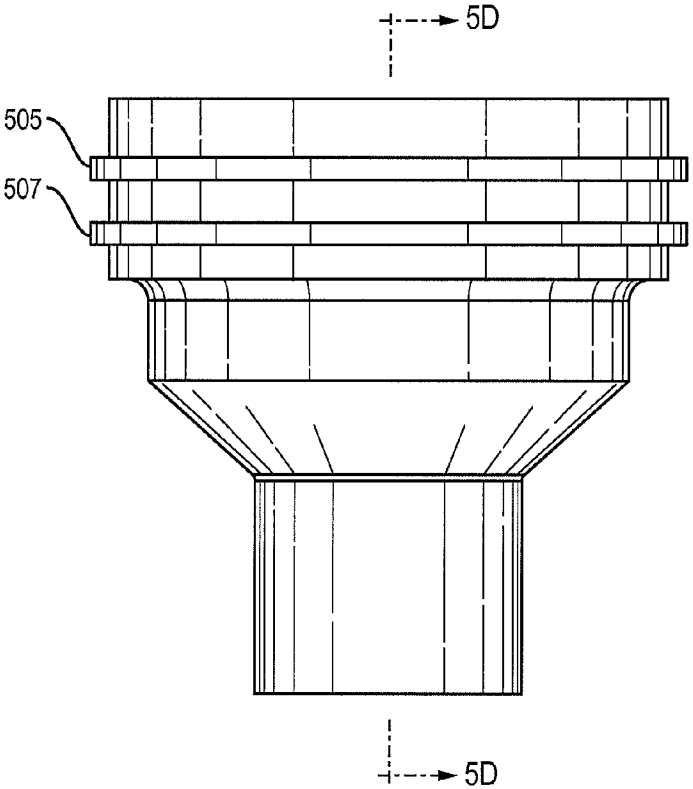

FIG. 5D shows the cross-sectional view of universal mount 500 having a smaller annular opening or inlet on the bottom or proximal end that extends upward into the body portion of the universal mount and connects with the larger annular outlet at the top portion or distal end of the universal mount, which defines a large inside cavity to accommodate for a variety of water feature components to be place therein. As noted above, locking tabs may extend into this cavity, the walls may be sloped towards the smaller annular inlet or opening, but it is contemplated that a variety of internal shapes may be used. For instance, there may be no need for sloped sides.

A reduced cross-sectional fluid bearing wall 527 extends into the smaller annular opening channel contained on the proximal end. This bearing wall extension also in part forms a ring cavity 525 that partially surrounds the bearing wall extension. This configuration has a variety of applications, for instance a pipe inserted into the smaller annular opening on the proximal and may fit snugly into the ring cavity area 525. A pipe may be slightly recessed and the ring cavity area 525 may cause a desired turbulence of water flowing through the universal mount. However, in most applications, ring cavity 525 is used as a reservoir to catch excess glue used to secure a pipe inside the smaller annular opening channel, so as not to interfere with the portion of a water spindle or other feature placed inside the fluid bearing wall 527. Fluid bearing wall 527 is used in part to form a water bearing system in conjunction with a water spindle, such as the one described below, or other rotating water feature. Thus, eliminating the need for actual ball bearings, roller bearings, sleeves, or any other kind of bearings used in various water features that rotate. By eliminating the need for these additional bearings, cost is reduced and fewer components are required.

In another embodiment not illustrated, a second-level of locking tabs reside in the wall or cavity portion of a universal mount providing mounting for a second feature or component. In a universal mount with a non-sloped section or flat bottom or plane section flush with the opening to the smaller annular opening channel, these locking tabs may be mounted on this flat bottom or plane section.

FIGS. 6A-D illustrate a water spindle feature 600. Water spindle 600, has an egress plane 604 where two egresses 602 reside. Each of these egresses extends into sub channel 610*a* or 610*b*, which branch off of main channel 612. Sub-channels 610*a-b* are angled off-axis of the main channel 612. The angled sub-channels are also off plane from each other. This helps cause rotation to occur in the spindle when water entering the main channel 612 is diverted off axis causing a momentum or angular force in the spindle 600. A rotational axis is formed concentrically with the annular opening/inlet into main channel 612 and the male receptor 620, which pivots and generally rotates about tip or apex 614 when rotatably connected with a corresponding female receiver. The force of fluid coming through the channels of the spindle also press male receptor into a female receiver as discussed above. The conical shape of male receptor helps steady the spindle against a corresponding female receiver's sloped walls. In some instances, the apex or tip 614 is the only portion of the male receptor touching or pivoting inside the female receiver and in other instances the conical shaped walls of each both the male and female components are rotating or sliding about each other. It is also contemplated that the tip or apex may have a more gradually rounded tip and in others the tip may be more sharp and focused.

Mounting outer section 608 is a reduced outer wall section of spindle 600 that fits inside a fluid bearing wall, such as the one described in universal mount 500 and forms a water bearing. When 608 is mounted within a water bearing wall, less importance is placed on stabilizing the rotation through the male receptor and thus other tip configurations may be utilized. As mentioned, by creating a water bearing for the water spindle 600 to rotate about, the need for heavy, expensive, and complex bearings is eliminated for rotating water features.

Figure 6A:
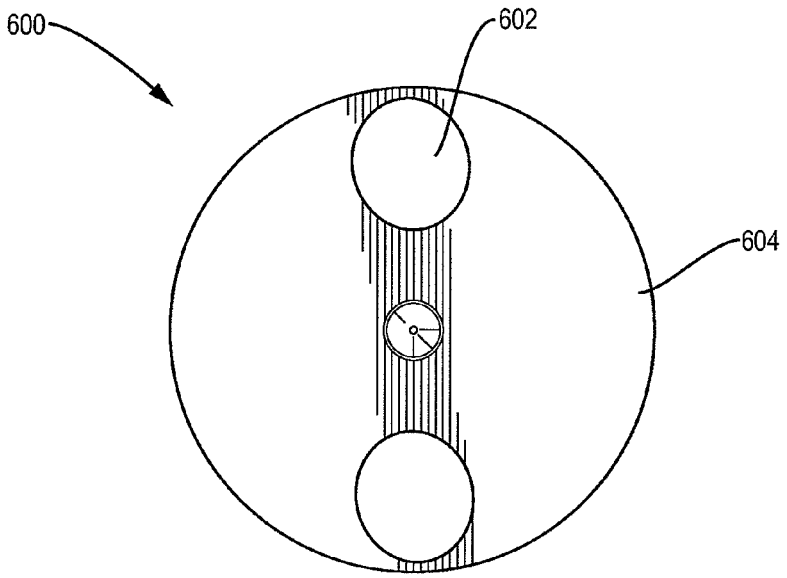
FIGS. 6A-D illustrate schematic drawings of a two-egress water spindle feature used in a spa jet system.
Figure 6B:
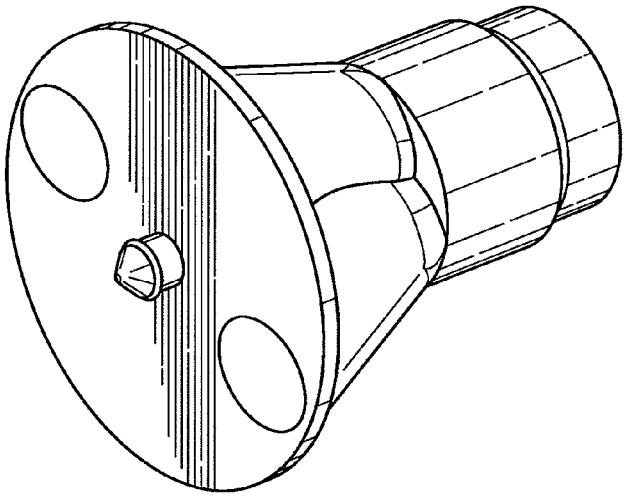
Figure 6D:
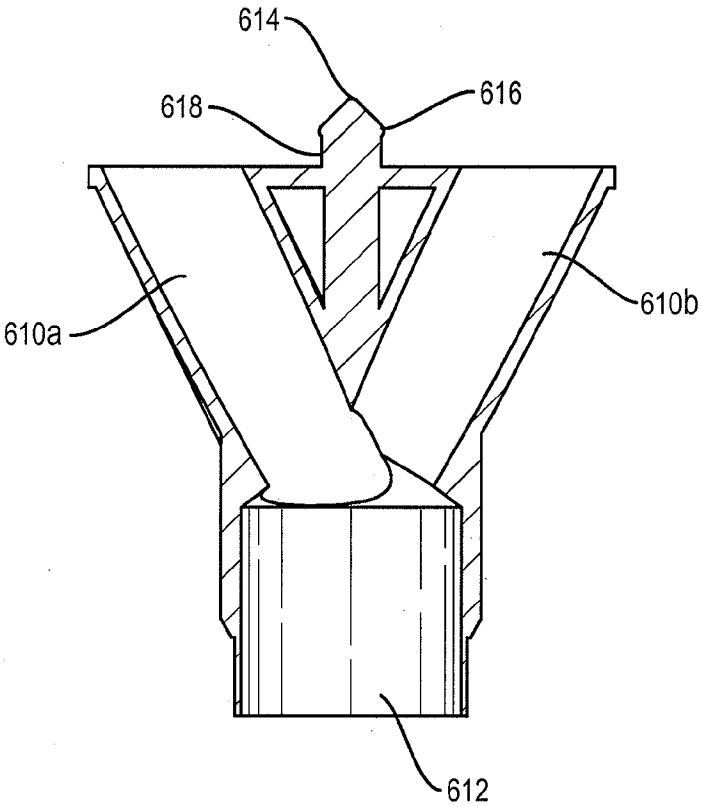
Figure 6C:
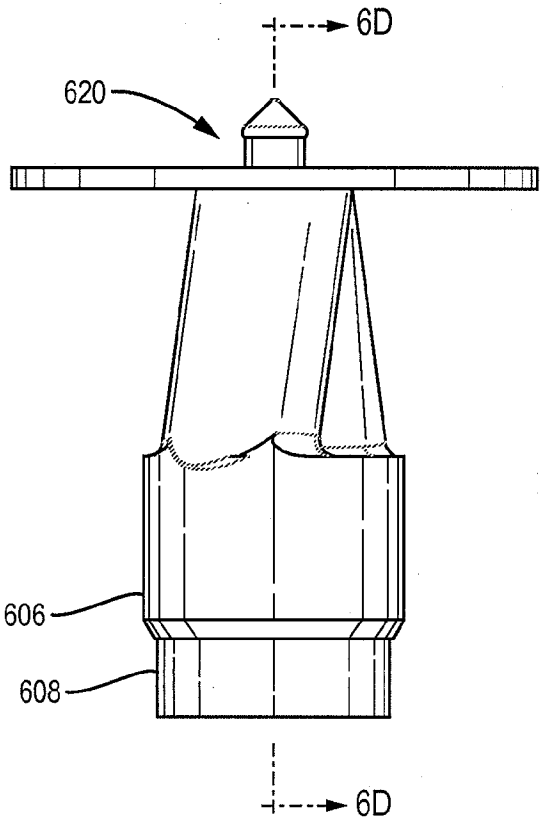

Also shown in the cross-sectional view of FIG. 6D is male receptor 620 with lip portion 616, which extends slightly beyond the outer diameter of side wall 618, in order to keep the receptor connected to a corresponding female receiver, such as 118. The thicker wall portion 606 as shown in FIG. 6C may be used to prevent spindle 600 from going too far into the smaller annular opening portion of universal mount 500. In another embodiment not shown lip portion 616 is removed and the increased diameter of thicker wall portion 606 coupled with the reduced diameter mounting outer section 608 inserted into a bearing wall of a universal mount is sufficient to keep the water spindle in place. Again the force of fluid flowing through the main channel of the spindle will force the male receptor to pivot and rotate about a female receiver. In this same alternative embodiment it is contemplated that the female receiver takes the form of a simple rounded indentation, notch or groove formed on the inside of the cover of an attaching or abutting faceplate about which the spindle may rotate.

Figure 7A:
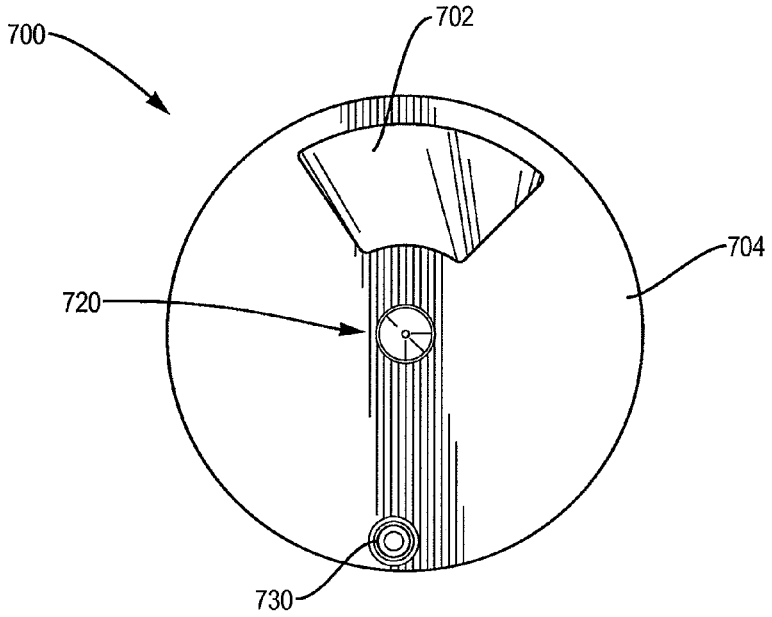
FIGS. 7A-D illustrate schematic drawings of an adjustable single egress water feature used to direct water flow.
Figure 7B:
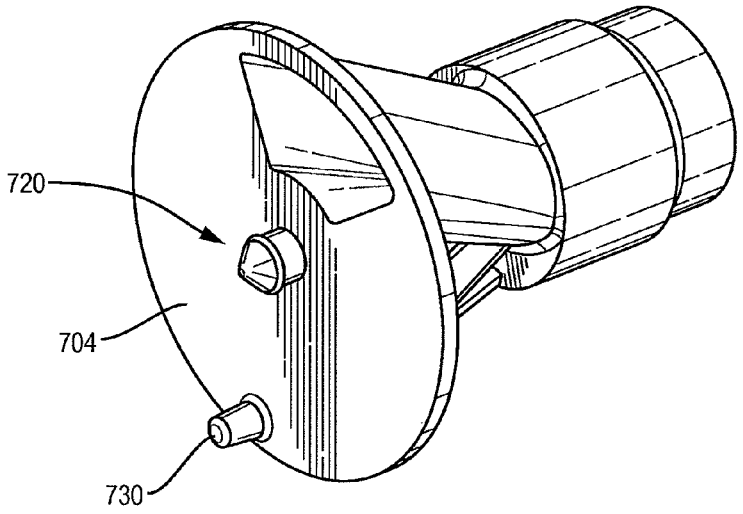
Figure 7D:
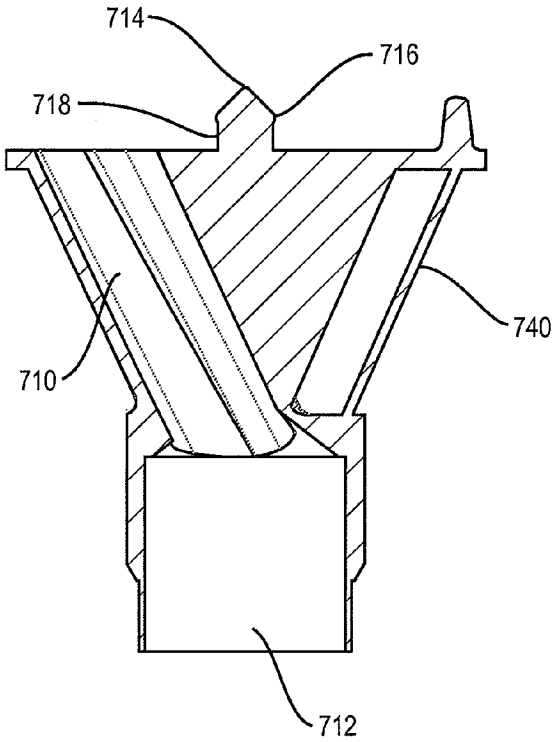
Figure 7C:
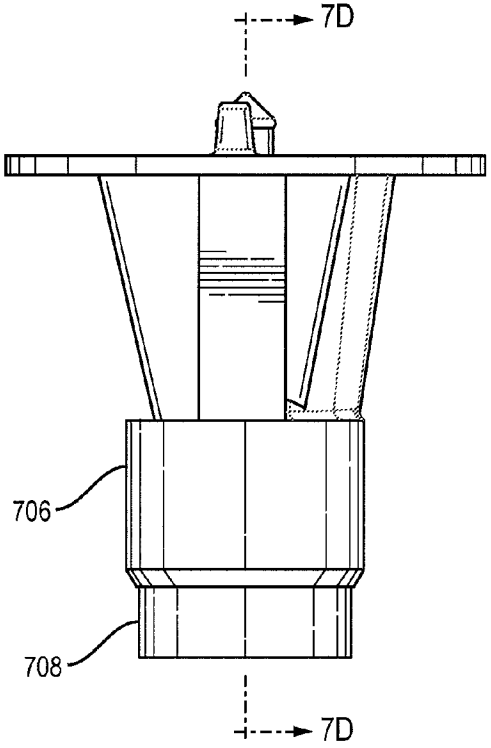

FIG. 7A-D illustrate a directional flow insert 700 to be used in combination with the faceplates in universal mount previously described. Like water spindle 600, directional flow 700 also has an egress plane 704 wherein a single egress 702 resides. It is within the scope of this application to have an egress plane with a plurality of egress is residing therein. 700 also has a male receptor 720 configured to be rotatably attached to female receiver. In addition, 700 has a second protrusion 730 or locking device extending from the egress plane 704. The second protrusion 730, blocking or locking device prevents 700 from rotating about an axis. Locking device 730 may be removably attached to egress plane 704. This locking device may interact with several faceplate designs to fix the position of egress 702 with respect to any fluid apertures formed through a cover of a faceplate. Thus resulting in being able to control the direction of the flow of water exiting a faceplate, directional flow insert, universal mount combined system. FIG. 7D shows a cross-sectional view of the directional flow insert 700. In this view is shown a main channel 712 leading into a sub channel 710, wherein the sub channel 710 is at an off axis angle to that of the main channel 712. A rib support 740, is used to stabilize the directional flow insert 700 including egress plane 704.

Again the locking device 730 shown herein, may be used with a variety of locking holes and/or fluid apertures contained in the cover of a faceplate. In one embodiment, 12 different positions may be achievable for the directional flow insert. However, this should not be construed as a maximum or minimum. By removing the locking device 730, the directional flow insert 700 may revert to a water spindle type system and rotate freely.

As discussed, a number of spa or pool features may be interchangeably used in conjunction with the universal mount and water feature cover or faceplates. For instance, spa features that might be used include jets, drains, return fittings, suction fittings, underwater lights, spinner features, filters, fountain heads, fountain scuppers, cleaning heads, sleeves, plugs, covers, anchors, or speakers. It is understood that spa feature and pool feature may be used to describe an insertable component designed to be removably attached and inserted into an interchangeable or universal mount. For example, some pools use rope anchors to create swimming or lap lanes. When swimming or lap lanes are not desired, the insertable anchor support may be removed and replaced with another feature such as plug, cover, sleeve, or even rotational water feature used with jets. Some community pools provide hours for swim teams and later provide hours for water polo or open time activities. With the universal holders described herein, one could easily replace lap lanes with apparatus to place water polo nets, basketball hoops, or other recreational apparatus designed to complement the swimming pool.

The above description is merely illustrative. Having thus described several aspects of at least one embodiment of this invention including the preferred embodiments, it is to be appreciated that various alterations, modifications, and improvements will readily occur to those skilled in the art.

Such alterations, modifications, and improvements are intended to be part of this disclosure, and are intended to be within the spirit and scope of the invention. Accordingly, the foregoing description and drawings are by way of example only.

What is claimed is:

1. A pool or spa water feature for an in-ground pool or spa wherein air and water are pre-mixed in a conduit embedded in a lateral wall of the pool or spa so as to be within the ground and mounted parallel to the surface of the ground, the air-water mixture flowing in the conduit a proximal to distal direction into the pool or spa, comprising:

a universal mount comprising:

an annular opening formed on a proximal end of a mount body that extends into an annular opening channel and a cavity formed in the mount body, and wherein the cavity extends to an outlet formed on a distal end of the mount body, the annular opening being configured to receive the air-water mixture and to be in fluid communication with the conduit;

at least one internal locking tab extending into the cavity and configured to lock with at least one external locking tab extending from a water feature faceplate of a faceplate body; and at least two flanges extending annularly along an outer wall of the mount body;

the water feature faceplate comprising:

a hollow annular-shaped body having an annular shaped opening defining a proximal end of the faceplate body and a faceplate cover containing at least one fluid aperture defining a distal end of the faceplate body, wherein a cavity is formed between the proximal and distal ends of the faceplate body;

and a female receiver substantially concentrically aligned with the annular shaped opening, formed in the faceplate cover, a spindle comprising:

a spindle body comprising a partially cylindrical conduit having a diameter less than that of the mount body and freely rotabable therein but not supported thereby, the spindle body having a proximal end defining an annular opening in communication with the spindle body conduit, wherein a main fluid channel extends through the spindle body conduit from the annular opening, the spindle body conduit being axially aligned with the in-ground conduit to receive the flow of air-water mixture;

an egress plane formed on the spindle body, wherein the egress plane contains at least one egress extending from the main fluid channel; and a male receptor extending from the egress plane, wherein the male receptor is configured to rotatably connect with a press-fit removable connection within the female receiver of the water feature faceplate, and wherein the male receptor is positioned substantially concentric with the annular opening of the spindle body, wherein the spindle is configured to rotate with respect to the water feature faceplate about the rotatably connected male receptor and female receiver, and wherein the press-fit connection supports the spindle.

2. The water feature of claim 1, wherein the main fluid channel branches into two sub-channels, and wherein each sub-channel extends into a separate egress contained on the egress plane.

3. The water feature of claim 1, wherein a portion of the main fluid channel extending into the egress resides at an angle with respect to the egress plane.

4. The water feature of claim 1, wherein the male receptor has a conically-shaped head.

5. The water feature of claim 4, wherein a rounded apex is formed on the conically-shaped head.

6. The water feature of claim 1, further including a flange extending from the distal end of the faceplate body.

7. The water feature of claim 6, further including at least two slots extending through the flange.

8. The universal mount of claim 1, further including an internal reservoir formed in the annular opening cavity.

9. The water feature of claim 1, configured such that the air-water mixture entering the annular opening of the universal mount flows into the main channel of the spindle and exits through the egress plane causing the spindle to rotate about the male receptor female receiver connection, wherein a spa jet system is formed.

10. The water feature of claim 9, wherein the spindle rotates about an axis formed concentrically with the annular opening of the spindle and the male receptor.

11. The water feature of claim 1, wherein the spindle and water feature faceplate are configured to be removably connected about their respective male receptor and female receiver, and wherein the water feature faceplate and universal mount are removably connected about their respective external and internal locking tabs.

12. The water feature of claim 1, further including a wall formed at least partially in the annular opening cavity of the universal mount, wherein the wall and an outer mounting wall formed in part around the main channel of the spindle are configured to function as a fluid bearing when fluid flows through the annular opening on the proximal end of the universal mount into the main channel of the spindle.

* * * * *